United States Patent [19]

Koike et al.

[11] Patent Number: 4,507,671

[45] Date of Patent: Mar. 26, 1985

[54] THERMOSENSITIVE RECORDING SHEET

[75] Inventors: Naomasa Koike; Shigetoshi Hiraishi, both of Tokyo, Japan

[73] Assignee: Mitsubishi Paper Mills, Ltd., Tokyo, Japan

[21] Appl. No.: 588,106

[22] Filed: Mar. 9, 1984

[30] Foreign Application Priority Data

Mar. 11, 1983 [JP] Japan ..... 58-41222

[51] Int. Cl.[3] ..... B41M 5/18

[52] U.S. Cl. ..... 346/216; 346/208; 346/209; 346/225; 427/150

[58] Field of Search ..... 106/14.5, 21; 346/208, 346/209, 216, 217, 225; 427/150, 151, 152, 153

[56] References Cited

U.S. PATENT DOCUMENTS 3,911,171 10/1975 Janssens et al. ..... 427/145

3,965,282 6/1976 Janssens et al. ..... 346/216

*Primary Examiner*—Bruce H. Hess

*Attorney, Agent, or Firm*—Cushman, Darby & Cushman

[57] ABSTRACT

A thermosensitive recording sheet containing in its thermosensitive layer dimethyl 4-hydroxy-phthalate as color developer and further containing if desired dimethyl terephthalate and/or a 2-tert-butylphenol derivative is excellent in color development sensitivity characteristic and recorded image stability.

27 Claims, No Drawings

THERMOSENSITIVE RECORDING SHEET

This invention relates to a thermosensitive recording sheet, more particularly to a thermosensitive recording sheet improved in color development sensitivity and recorded image stability.

Thermosensitive recording system is finding use for various sorts of communication means such as printers and telephone facsimile owing to its many merits in practical application such as no noise in recording operation because of non-impact type recording, no necessity of development and fixing, easy maintenance and management of the apparatus, etc. In the field of telephone facsimile in particular, there has been a sharp increase of demand for the thermosensitive system and rapid strides have been made in speed-up of operation for the transmission cost reduction. In order to keep pace with such speed-up of facsimile, request is rising for the further improvement in sensitivity of the thermosensitive recording material.

In high speed facsimile, the electric current flow to ther thermal head iterates with an extremely short time duration of 1 to 2 milliseconds for effecting the reception and transmission of an A4 standard original in a period of 10 to 20 seconds and the heat energy produced in the thermal head is transferred to a thermosensitive recording sheet to initiate an image forming reaction. In order that the desired image forming reaction may be accomplished with the heat energy transferred in such a short time, it is essential that the thermosensitive recording sheet has an excellent heat responsiveness.

Usually, thermosensitive paper has as its essential components a dye precursor and a color developer, and in order to heighten the heat responsiveness, it is necessary to lower the melting point of the color developer while improving its compatibility with the dye precursor. A senstizier is also used optionally. Sensitizer serves to promote the color developing reaction by dissolving or incorporating the nearby dye precursor and color developer when the sensitizer itself is melted by the transferred heat energy, so that it is an effective way for increasing the sensitivity of the thermosensitive recording sheet to improve the heat responsiveness of the sensitizer.

As a result of extensive studies on the materials of thermosensitive recording sheet under the said conception, the present inventors found that the color development sensitivity of the recording sheet can be improved by using dimethyl 4-hydroxyphthalate as color developer. As the test results demonstrate, dimethyl 4-hydroxy-phthalate provides a marked improvement of color development sensitivity in comparison with bisphenol A and other materials used as color developer in the conventional thermosensitive papers when the weight ratio of color developer to dye precursor is fixed. In use of dimethyl 4-hydroxy-phthalate as color developer for a thermosensitive recording sheet, its ratio by weight to dye precursor is preferably above 1, more preferably above 2, and even more preferably above 3, but it is preferably not greater than 6, more preferably not greater than 5, are even more preferably not greater than 4. Thus, the most preferred range of said ratio is 3 to 4.

If said ratio is less than 1, no satisfactory color development sensitivity is obtained, and also retentivity of the color developed portion after 24-hour standing under an environment of 40° C. and 90% RH, is found poor. If said ratio is greater than 6, both color development sensitivity and retentivity of the color developed portion prove too bad for practical use.

The present inventors also found that the combined use of dimethyl terephthalate as sensitizer with said color developer leads to a further improvement of color development sensitivity. When using dimethyl terephthalate as sensitizer, its ratio by weight to said color developer is preferably above 0.1, more preferably above 0.2, and even more preferably above 0.4, but it is preferably not greater than 0.8, more preferably not greater than 0.6, and even more preferably not greater than 0.5. Thus, the most preferred range of said ratio is 0.4 to 0.5.

The color development sensitivity can be improved even if said ratio is less than 0.1, but said ratio needs be above 0.1 for obtaining a conspicuous improvement of sensitivity. In the latter case, retentivity of the color developed portion is also improved. The increase of said ratio above 0.8 does not lead to any additional improvement of color development sensitivity; it rather tends to deteriorate said sensitivity and to also cause a reduction of retentivity of the color developed portion.

The present inventors noted that the use of dimethyl 4-hydroxy-phthalate as color developer ensures a good color development under every possible use conditions, but in the heat test, moisture test and weather resistance test, the color developed portion showed a tendency to fade, and thus retention of the color developed portion was not always satisfactory. Also, due to its slight sublimating disposition, said color developer tends to cause precipitation of white powder, or so-called blooming, on the surface of the color developed portion.

Further studies on this point by the present inventors have led to the finding that the use of a 2-tert-butylphenol derivative in combination with said color developer can prevent the fading of the color developed portion, allowing the obtainment of a thermosensitive recording sheet with improved retentivity of the color developed portion.

In this invention, a 2-tert-butylphenol derivative is used in such an amount that its ratio by weight to said color developer is preferably above 0.1, more preferably above 0.2, and even more preferably above 0.3, but said ratio is preferably not greater than 0.6, more preferably not greater than 0.5, and even more preferably not greater than 0.4. If said ratio is below 0.1, no satisfactory retentivity of the color developed portion is obtained. Any ratio above 0.6 can not provide a further improvement of retentivity; rather it tends to deteriorate said retentivity and also lowers the color development sensitivity.

As the 2-tert-butylphenol derivative used in this invention, there can be cited 2,2-bis(3-tert-butyl-4-hydroxy-6-methylphenyl)propane, 4,4'-thiobis(2-tert-butyl-5-methylphenol) and the like, but 1,1,3-tris(3-tert-butyl-4-hydroxy-6-methylphenyl)butane is found especially preferred.

The preferred ratio by weight of 1,1,3-tris(3-tert-butyl-4-hydroxy-6-methylphenyl)butane to dimethyl 4-hydroxyphthalate used as color developer is the same as defined above in terms of 2-tert-butylphenol derivative.

Combined use of dimethyl terephthalate and a 2-tert-butylphenol derivative with dimethyl 4-hydroxyphthalate as color developer heightens both color development sensitivity and retentivity of the color developed portion to give the most desirable result. In this case, 1,1,3-tris(3-tert-butyl-4-hydroxy-6-methylphenyl)butane is best suited for use as 2-tert-butylphenol derivative.

The ratio by weight of the sum of dimethyl terephthalate and a 2-tert-butylphenol derivative (for example, 1,1,3-tris(3-tert-butyl-4-hydroxy-6-methylphenyl)-butane) to the color developer is preferably above 0.2, more prererably above 0.26, even more preferably above 0.4, and most preferably above 0.6, but it is preferably not greater than 1.2, more preferably not greater than 0.8. If said ratio is below 0.2, both color development sensitivity and retentivity of the color developed portion prove unsatisfactory. If said ratio is greater than 1.2, no desired color development sensitivity is obtained, and also no further improvement of retentivity of the color developed portion can be expected, such retentivity being rather slightly deteriorated.

When the ratio by weight of the sum of dimethyl terephthalate and a 2-tert-butylphenol derivative (such as 1,1,3-tris(3-tert-butyl-4-hydroxy-6-methylphenyl)butane) to said color developer is given, the ratio by weight of said 2-tert-butylphenol derivative (such as 1,1,3-tris(3-tert-butyl-4-hydroxy-6-methylphenyl)butane) to dimethyl terephthalate is preferably within the range of 1:5 to 5:1, more preferably 2:4 to 3:3. If said ratio is below 1:5 (1/5), no satisfactory retentivity of the color developed portion is provided and also the color development sensitivity tends to lower. In case said ratio is greater than 5:1 (5/1), there is provided no sufficient color development sensitivity. The best result is obtained when the ratio by weight of the same of dimethyl terephthalate and a 2-tert-butylphenol derivative to said color developer is within the range from 0.4 to 0.8 and the ratio by weight of said 2-tert-butylphenol derivative to dimethyl terephthalate is within the range of 2:4 to 3:3, and in this case, it is most preferred to use 1,1,3-tris(3-tert-butyl-4-hydroxy-6-methylphenyl)butane as the 2-tert-butylphenol derivative.

The principal components used in this invention will be described more definitely below, but as obvious to those skilled in the art, the other materials than those mentioned hereinbelow can be used as well without departing from the principle of the invention.

(1) Dye precursor

The dye precursors conventionally used for thermosensitive paper can be employed in this invention, such dye precursors including: crystal violet lactone, 3-diethylamino-7-methylfluoran, 3-diethylamino-6-chloro-7-methylfluoran, 3-diethylamino-6-methyl-7-chlorofluoran, 3-diethylamino-7-anilinofluoran, 3-diethylamino-7-(2'-chloroanilino)fluoran, 3-dibutylamino-7-(2'-chloroanilino)fluoran, 3-diethylamino-7-(3'-chloroanilino)fluoran, 3-diethylamino-6-methyl-7-anilinofluoran, 3-(N-ethyl-p-toluidino)-6-methyl-7-anilinofluoran, 3-(N-methylcyclohexylamino)-3-methyl-7-anilinofluoran, 3-piperidino-3-methyl-7-anilinofluoran and the like.

(2) Binder

The following can be used as binder in this invention: starch (various types), hydroxyethyl cellulose, methyl cellulose, polyvinyl alcohol, styrene-maleic anhydride copolymer, styrenebutadiene copolymer, polyacrylamide, and the like.

(3) Pigment

The pigments usable in this invention include: diatomaceous earth, talc, kaolin, calcined kaolin, calcium carbonate, magnesium carbonate, titanium oxide, zinc oxide, silicon oxide, aluminum hydroxide, ureaformaldehyde resin, and the like.

The present invention will be described in further detail hereinbelow by way of its examples and comparative examples.

EXAMPLE 1 (PREPARATION OF DISPERSIONS)

(1) Solution A 40 g of dimethyl 4-hydroxy-phthalate is added to an aqueous solution of 8 g of Malon MS-25 (a 25% aqueous solution of sodium salt of styrene-maleic anhydride copolymer, produced by Daido Kogyo KK) in 85.3 g of water under stirring, and the resulting dispersion is triturated and dispersed by a ball mill for 48 hours.

(2) Solution B 40 g of dimethyl terephthalate is added to an aqueous solution of 8 g of Malon MS-25 in 85.3 g of water under stirring, and the resulting dispersion is triturated and dispersed by a ball mill for 48 hours.

(3) Solution C 40 g of 1,1,3-tris(3-tert-butyl-4-hydroxy-6-methylphenyl)butane is added to an aqueous solution of 8 g of Malon MS-25 in 85.3 g of water under stirring, and the resulting dispersion is triturated and dispersed by a ball mill for 48 hours.

(4) Solution D (dye dispersion)

A dispersion prepared from 200 g of 3-diethylamino-6-methyl-7-anilinofluoran, 24 g of Malon MS-25 and 276 g of water is triturated and dispersed by a ball mill for 48 hours.

EXAMPLE 2

By using the dispersions obtained in Example 1, a thermosensitive coating solution of the following composition was prepared:

| | |
|---|---|
| Calcium Carbonate PC (calcium carbonate produced by Shiraishi Kogyo KK) | 5 g |
| Solution A | 6.7 g |
| Solution B | 10 g |
| Solution D | 5 g |
| 15% aqueous solution of polyvinyl alcohol | 20 g |
| Water | 13.3 g |

This thermosensitive coating solution was coated on a base paper with a basis weight of 50 g/m$^2$ so that the coating weight after drying would be 5.3 g/m$^2$, and the thus coated paper was further treated by a super calendar to a Bekk smoothness of about 600 seconds to make a thermosensitive paper.

EXAMPLE 3

By using the dispersions obtained in Example 1, a thermosensitive coating solution of the following composition was prepared:

| | |
|---|---|
| Calcium Carbonate PC (calcium carbonate produced by Shiraishi Kogyo KK) | 5 g |
| Solution A | 6.7 g |
| Solution C | 10 g |
| Solution D | 5 g |
| 15% aqueous solution of polyvinyl alcohol | 20 g |
| Water | 13.3 g |

This thermosensitive coating solution was coated on a base paper of 50 g/m² in basis weight to a coating weight of 5.3 g/m² after drying, and the coated base paper was further treated by a super calender to a Bekk smoothness of about 600 seconds to make a thermosensitive paper.

EXAMPLE 4

A thermosensitive coating solution of the following composition was prepared by using the dispersions obtained in Example 1.

| | |
|---|---|
| Calcium Carbonate PC (calcium carbonate produced by Shiraishi Kogyo KK) | 5 g |
| Solution A | 6.7 g |
| Solution B | 10 g |
| Solution C | 6.7 g |
| Solution D | 5 g |
| 15% aqueous solution of polyvinyl alcohol | 23.3 g |
| Water | 30.8 g |

The above thermosensitive coating solution was coated on a base paper of 50 g/m² in basis weight to a coating weight of 7.0 g/m² after drying and the coated base paper was treated by a super calendar to a Bekk smoothness of about 600 seconds to produce a thermosensitive paper.

EXAMPLE 5

By using the dispersions obtained in Example 1, a thermosensitive coating solution of the following composition was prepared:

| | |
|---|---|
| Calcium Carbonate PC (calcium carbonate produced by Shiraishi Kogyo KK) | 5 g |
| Solution A | 6.7 g |
| Solution D | 5 g |
| 15% aqueous solution of polyvinyl alcohol | 15 g |
| Water | 24.6 g |

This thermosensitive coating solution was coated on a base paper of 50 g/m² in basis weight to a coating weight of 4.5 g/m² after drying and the thus coated base paper was further treated by a super calender to a Bekk smoothness of about 600 seconds to make a thermosensitive paper.

The thermosensitive recording sheets produced in Examples 2, 3, 4 and 5 were subjected to the following tests for quality evaluation.

TEST 1

Printing was made on each thermosensitive recording sheet with Fujitsu Facomfax 621 C and the color (print) density was measured.

TEST 2

Each sample sheet which was color-printed in Test 1 was kept under an environment of 60° C. for 24 hours and then the retentivity of the color developed (print) portion was evaluated.

TEST 3

Each sample sheet which was color-printed in Test 1 was kept under an environment of 40° C. and 90% RH for 24 hours and then the retentivity of the color developed (print) portion was evaluated.

TEST 4

Each sample sheet which was color-printed in Test 1 was left under room temperature for 24 hours and "blooming" on the sheet surface was checked.

The results of evaluation are shown in Table 1.

TABLE 1

| | Test 1 Color density | Test 2 Color density after test | Test 3 Color density after test | Test 3 Retention (%) | Test 4 Whether blooming occured or not |
|---|---|---|---|---|---|
| Example 2 | 1.26 | 1.22 | 1.15 | 91.3 | Bloomed |
| Example 3 | 1.15 | 1.17 | 1.16 | 100.9 | No blooming |
| Example 4 | 1.23 | 1.29 | 1.23 | 100 | No blooming |
| Example 5 | 1.16 | 1.12 | 1.02 | 87.9 | Bloomed |

As seen from Table 1, the addition of dimethyl terephthalate with dimethyl 4-hydroxy-phthalate provides a further improvement of color development sensitivity (Example 2), and the addition of 1,1,3-tris(3-tert-butyl-4-hydroxy-6-methylphenyl)butane improves the image keeping quality and keeps off blooming (Example 3). Combined use of these materials gives a thermosensitive recording sheet with excellent color developing characteristic and image keeping quality (Example 4).

EXAMPLES 6–11 AND COMPARATIVE EXAMPLES 1–6

By using the dispersions obtained in Example 1, a thermosensitive coating solution of the following composition (Example 6) was prepared:

| | |
|---|---|
| Calcium Carbonate PC (calcium carbonate produced by Shiraishi Kogyo KK) | 8 g |
| Solution A | 6.7 g |
| Solution B | 5 g |
| 15% aqueous solution of polyvinyl alcohol | 20 g |

Water was added to the solution to make its concentration 20% 20% by weight.

The thermosensitive coating solutions of Examples 7 to 11 were prepared in the same way as Example 6 except that the amount of the solution A was changed to 13.3 g, 20.0 g, 26.7 g, 33.3 g and 40.0 g, respectively.

Also, the coating solutions of Comparative Examples 1 to 6 were prepared similarly to Examples 6 to 11, respectively, except that dimethyl 4-hydroxyphthalate in the solution A was changed to bisphenol A (BPA).

Each of the thus prepared thermosensitive coating solutions of Examples 6–11 and Comparative Examples 1–6 was coated on a base paper with a basis weight of 50 g/m² so that the coating weight of the dye precursor after drying would become 0.5 g/m², and the coated paper was treated by a super calender to a Bekk smoothness of about 600 seconds to make a thermosensitive paper.

EXAMPLES 12–23

By using the dispersions obtained in Example 1, a thermosensitive coating solution of the following composition was prepared as Example 12:

| | |
|---|---|
| Calcium Carbonate PC (calcium carbonate produced by Shiraishi Kogyo KK) | 8 g |
| Solution A | 20 g |
| Solution B | 2 g |
| Solution D | 5 g |
| 15% aqueous solution of polyvinyl alcohol | 20 g |

Water was added to the solution to make its concentration 20% by weight.

The coating solutions of Examples 13 to 17 were prepared in the same way as Example 12 except that the amount of the solution B was changed to 4 g, 8 g, 10 g, 12 g and 16 g, respectively.

There were also prepared the coating solutions of Examples 18 to 23 similarly to Examples 12 to 17, respectively, except that dimethyl terephthalate in the solution B was changed to N-hydroxymethylstearic acid amide.

The thus prepared coating solutions were treated after the manner of Example 6 to make the thermosensitive papers of Examples 12 to 23.

EXAMPLES 24–35

By using the dispersions obtained in Example 1, a thermosensitive coating solution of Example 24 was prepared with the following composition:

| | |
|---|---|
| Calcium Carbonate PC (calcium carbonate produced by Shiraishi Kogyo KK) | 8 g |
| Solution A | 20 g |
| Solution C | 2 g |
| Solution D | 5 g |
| 15% aqueous solution of polyvinyl alcohol | 20 g |

The solution was diluted with water to a concentration of 20% by weight.

The similar coating solutions of Examples 25 to 29 were prepared in the same way as Example 24 except that the amount of the solution C was changed to 4 g, 6 g, 8 g, 10 g and 12 g, respectively.

There were further prepared the coating solutions of Examples 30 to 35 following the pattern of Examples 24 to 29, respectively, except that 1,1,3-tris(3-tert-butyl-4-hydroxy-6-methylphenyl)butane in the solution C was changed to 1,1-bis(3-tert-butyl-4-hydroxy-6-methylphenyl)butane.

These coating solutions were treated similarly to Example 6 to make the thermosensitive papers of Examples 24–35.

EXAMPLES 36–47

By using the dispersions obtained in Example 1, a thermosensitive coating solution of Example 36 was prepared with the following composition:

| | |
|---|---|
| Calcium Carbonate PC (calcium carbonate produced by Shiraishi Kogyo KK) | 8 g |
| Solution A | 20 g |
| Solution B | 2 g |
| Solution C | 2 g |
| Solution D | 5 g |
| 15% aqueous solution of polyvinyl alcohol | 20 g |

Water was added to the solution to dilute it to a concentration of 20% by weight.

The coating solutions of Examples 37 to 41 were prepared in the same way as Example 36 except that the amounts of the solution B and solution C were changed to 2.6 and 2.6 g, 4 and 4 g, 6 and 6 g, 8 and 8 g, and 12 and 12 g, respectively.

There were also prepared the coating solutions of Examples 42 to 47 after the pattern of Examples 36 to 41, respectively except that 1,1,3-tris(3-tert-butyl-4-hydroxy-6-methylphenyl)butane in the solution C was changed to 1,1-bis(3-tert-butyl-4-hydroxy-6-methylphenyl)butane.

These coating solutions were treated according to the process of Example 6 to make the thermosensitive papers of Examples 36 to 47.

EXAMPLES 48–57

By using the dispersions obtained in Example 1, a thermosensitive coating solution of Example 48 was prepared with the following recipe:

| | |
|---|---|
| Calcium Carbonate PC (calcium carbonate produced by Shiraishi Kogyo KK) | 3 g |
| Solution A | 20 g |
| Solution B | 2 g |
| Solution C | 10 g |
| Solution D | 5 g |
| 15% aqueous solution of polyvinyl alcohol | 20 g |

The solution was added with water to have a concentration of 20% by weight.

The coating solutions of Examples 49 to 52 were prepared in the same manner as Example 48 except that the amounts of the solution B and solution C were changed to 4 and 8 g, 6 and 6 g, 8 and 4 g, and 10 and 2 g, respectively.

Also, the coating solutions of Examples 53 to 57 were prepared after the manner of Examples 48 to 52, respectively, except that 1,1,3-tris(3-tert-butyl-4-hydroxy-6-methylphenyl)butane in the solution C was changed to 1,1-bis(3-tert-butyl-4-hydroxy-6-methylphenyl)butane.

By using these coating solutions in the manner same as described in Example 6, there were produced the thermosensitive papers of Examples 48 to 57. The evaluation test results on these thermosensitive papers are shown in Tables 2 to 6. Test 5 was made as follows.

TEST 5

Printing was conducted on each thermosensitive paper with a long distance printing tester for thermosensitive paper, made by Matsushita Electronic Parts Co., Ltd., at a voltage of 16 V and a pulse width of 3.0 msec. and the print density was measured.

TABLE 2

| | Test 5 Color density | Test 3 Color density after test | Test 3 Retension (%) |
|---|---|---|---|
| Example | | | |
| 6 | 0.71 | 0.51 | 72 |
| 7 | 0.83 | 0.68 | 82 |
| 8 | 1.05 | 0.88 | 84 |

TABLE 2-continued

| | Test 5 Color density | Test 3 Color density after test | Test 3 Retension (%) |
|---|---|---|---|
| 9 | 1.08 | 0.91 | 84 |
| 10 | 1.02 | 0.84 | 82 |
| 11 | 0.95 | 0.77 | 81 |
| Comparative Example | | | |
| 1 | 0.58 | 0.41 | 70 |
| 2 | 0.64 | 0.52 | 82 |
| 3 | 0.78 | 0.65 | 83 |
| 4 | 0.82 | 0.69 | 84 |
| 5 | 0.82 | 0.68 | 83 |
| 6 | 0.75 | 0.59 | 78 |

TABLE 3

| Example | Test 5 Color density | Test 3 Color density after test | Test 3 Retention (%) |
|---|---|---|---|
| 12 | 1.08 | 0.90 | 83 |
| 13 | 1.15 | 0.97 | 84 |
| 14 | 1.26 | 1.08 | 86 |
| 15 | 1.25 | 1.05 | 84 |
| 16 | 1.18 | 0.99 | 84 |
| 17 | 1.12 | 0.92 | 82 |
| 18 | 1.05 | 0.86 | 82 |
| 19 | 1.06 | 0.88 | 83 |
| 20 | 1.12 | 0.93 | 83 |
| 21 | 1.14 | 0.96 | 84 |
| 22 | 1.09 | 0.89 | 82 |
| 23 | 1.03 | 0.84 | 82 |

TABLE 4

| Example | Test 5 Color density | Test 3 Color density after test | Test 3 Retention (%) |
|---|---|---|---|
| 24 | 1.06 | 0.92 | 87 |
| 25 | 1.07 | 0.98 | 92 |
| 26 | 1.07 | 1.02 | 95 |
| 27 | 1.05 | 1.01 | 96 |
| 28 | 1.03 | 0.98 | 95 |
| 29 | 1.02 | 0.97 | 95 |
| 30 | 1.05 | 0.89 | 85 |
| 31 | 1.06 | 0.92 | 87 |
| 32 | 1.07 | 0.95 | 89 |
| 33 | 1.05 | 0.96 | 91 |
| 34 | 1.02 | 0.93 | 91 |
| 35 | 1.02 | 0.92 | 90 |

TABLE 5

| Example | Test 5 Color density | Test 3 Color density after test | Test 3 Retention (%) |
|---|---|---|---|
| 36 | 1.07 | 0.93 | 87 |
| 37 | 1.12 | 1.05 | 94 |
| 38 | 1.16 | 1.10 | 95 |
| 39 | 1.21 | 1.17 | 97 |
| 40 | 1.20 | 1.15 | 96 |
| 41 | 1.12 | 1.08 | 96 |
| 42 | 1.06 | 0.89 | 84 |
| 43 | 1.11 | 1.01 | 91 |
| 44 | 1.15 | 1.04 | 90 |
| 45 | 1.21 | 1.10 | 91 |
| 46 | 1.20 | 1.09 | 91 |
| 47 | 1.12 | 1.02 | 91 |

TABLE 6

| Example | Test 5 Color density | Test 3 Color density after test | Test 3 Retention (%) |
|---|---|---|---|
| 48 | 1.07 | 1.03 | 96 |
| 49 | 1.12 | 1.06 | 95 |
| 50 | 1.20 | 1.14 | 95 |
| 51 | 1.20 | 1.14 | 95 |
| 52 | 1.12 | 1.04 | 93 |
| 53 | 1.06 | 0.98 | 92 |
| 54 | 1.12 | 1.01 | 90 |
| 55 | 1.20 | 1.07 | 89 |
| 56 | 1.19 | 1.07 | 90 |
| 57 | 1.11 | 1.01 | 91 |

As seen from Table 2, the products of this invention using dimethyl 4-hydrophthalate as color developer give a markedly higher color density of prints than obtainable with the products using BPA. Also, the former show an almost same retentivity as the latter, and hence the developed color density can be maintained high during storage. Further, use of said color developer in an amount of 3 to 5 times, espetially 3 to 4 times by weight the amount of the dye precursor extremely heightens the color density and also increases the retentivity to allow long-time maintenance of the high color density.

It will be seen from Table 3 that the combined use of dimethyl terephthalate with said color developer leads to a marked improvement of color density in comparison with, for instance the case where N-hydroxymethylstearic acid amide is used with said color developer. The effect of dimethyl terephthalate is especially high when it is used in an amount of 0.4 to 0.5 time the color developer by weight.

Table 4 demonstrates that the joint use of a 2-tert-butylphenol derivative, especially 1,1,3-tris(3-tert-butyl-4-hydroxy-6-methtlphenyl)butane, with said color developer provides a high image retention after storage, making it possible to keep high the print color density during storage. The effect of 1,1,3-tris(3-tert-butyl-r-hydroxy-6-methylphenyl)butane is higher than when using 1,1-bis(3-tert-butyl-4-hydroxy-6-methylphenyl)butane, and its effect is maximized when it is used in an amount of 0.3 to 0.4 time said color developer by weight.

It will be appreciated from Table 5 that when a 2-tert-butylphenol derivative, especially 1,1,3-tris(3-tert-butyl-4-hydroxy-6-methylphenyl)butane, is used in combination with said color developer, the resulting thermosensitive paper is provided with an ability to develop color with high density and also has a high image retentivity so that the developed color density can be maintained high during storage.

The effect of the 2-tert-butylphenol derivative is great when the total amount of this derivative and dimethyl terephthalate is 0.4 to 0.8 time by weight the amount of said color developer, and such effect is eminent when 1,1,3-tris(3-tert-butyl-4-hydroxy-6-methylphenyl)butane is used as said derivative. Table 6 discloses the fact that the effect of the 2-tert-butylphenol derivative is maximized when the ratio by weight of said derivative, especially 1,1,3-tris(3-tert-butyl-4-hydroxy-6-metnyl-phenyl)butane, to dimethyl terephthalate is in the range from 2:4 to 3:3.

From the results shown in Tables 1–6, it is found that the present invention can be best embodied by using dimethyl 4-hydroxy-phthalate as color developer in an amount of 3 to 5 times by weight the dye precursor and further incorporating in said color developer 1,1,3-tris(3-tert-butyl-4-hydroxy-6-methylphenyl)butane and dimethyl terephthalate such that their total amount is 0.4 to 0.8 time, especially 0.6 to 0.8 time by weight said color developer and that the ratio by weight of 1,1,3-tris(3-tert-butyl-4-hydroxy-6-methylphenyl)butane to dimethyl terephthalate is in the range from 2:4 to 3:3.

What is claimed is:

1. A thermosensitive recording sheet comprising a support and formed thereon a thermosensitive layer containing a usually colorless or light-colored dye precursor and a color developer which is reacted with said dye precursor under heating to develop a color, characterized in that dimethyl 4-hydroxy-phthalate is used as said color developer.

2. A thermosensitive recording sheet according to claim 1, wherein the ratio by weight of dimethyl 4-hydroxyphthalate to the dye precursor is from 1 to 6.

3. A thermosensitive recording sheet according to claim 2, wherein said ratio is from 2 to 6.

4. A thermosensitive recording sheet according to claim 3, wherein said ratio is from 3 to 6.

5. A thermosensitive recording sheet according to claim 4, wherein said ratio is from 3 to 5.

6. A thermosensitive recording sheet according to claim 5, wherein said ratio is from 3 to 4.

7. A thermosensitive recording sheet according to claim 1, wherein said thermosensitive layer contains dimethyl terephthalate.

8. A thermosensitive recording sheet according to claim 7, wherein the ratio by weight of dimethyl terephthalate to dimethyl 4-hydroxy-phthalate is from 0.1 to 0.8.

9. A thermosensitive recording sheet according to claim 8, wherein said ratio is from 0.2 to 0.6.

10. A thermosensitive recording sheet according to claim 9, wherein said ratio is from 0.4 to 0.5.

11. A thermosensitive recording sheet according to claim 1, wherein said thermosensitive layer contains a 2-tert-butylphenol derivative.

12. A thermosensitive recording sheet according to claim 11, wherein the 2-tert-butylphenol derivative is 1,1,3-tris(3-tert-butyl-4-hydroxy-6-methylphenyl)butane.

13. A thermosensitive recording sheet according to claim 12, wherein the ratio by weight of 1,1,3-tris(3-tert-butyl-4-hydroxy-6-methylphenyl)butane to diemthyl 4-hydroxy-phthalate is from 0.1 to 0.6.

14. A thermosensitive recording sheet according to claim 13, wherein said ratio is from 0.2 to 0.6.

15. A thermosensitive recording sheet according to claim 14, wherein said ratio is from 0.3 to 0.4.

16. A thermosensitive recording sheet according to claim 11, wherein the ratio by weight of the 2-tert-butylphenol derivative to dimethyl 4-hydroxy-phthalate is from 0.3 to 0.4.

17. A thermosensitive recording sheet according to claim 11, wherein the thermosensitive layer contains dimethyl terephthalate in addition to a 2-tert-butylphenol derivative.

18. A thermosensitive recording sheet according to claim 17, wherein the 2-tert-butylphenol derivative is 1,1,3-tris(3-tert-butyl-4-hydroxy-6-methylphenyl)butane.

19. A thermosensitive recording sheet according to claim 18, wherein the ratio by weight of the total amount of 1,1,3-tris(3-tert-butyl-4-hydroxy-6-methylphenyl)butane and dimethyl terephthalate to dimethyl 4-hydroxyphthalate is from 0.2 to 1.2.

20. A thermosensitive recording sheet according to claim 19, wherein said ratio is from 0.26 to 1.2.

21. A thermosensitive recording sheet according to claim 20, wherein said ratio is from 0.4 to 0.8.

22. A thermosensitive recording sheet according to claim 21, wherein said ratio is from 0.6 to 0.8.

23. A thermosensitive recording sheet according to claim 17, wherein the ratio by weight of the total amount of the 2-tert-butylphenol derivative and dimethyl terephthalate to dimethyl 4-hydroxy-phthalate is from 0.6 to 0.8.

24. A thermosensitive recording sheet according to claim 19, wherein the ratio by weight of 1,1,3-tris(3-tert-butyl-4-hydroxy-6-methylphenyl)butane to dimethyl terephthalate is in the range of 1:5 to 5:1.

25. A thermosensitive recording sheet according to claim 24, wherein said ratio is in the range of 2:4 to 3:3.

26. A thermosensitive recording sheet according to claim 21, wherein the ratio by weight of 1,1,3-tris(3-tert-butyl-4-hydroxy-6-methylphenyl)butane to dimethyl terephthalate is in the range of 2:4 to 3:3.

27. A thermosensitive recording sheet according to claim 23, wherein the ratio by weight of the 2-tert-butylphenol derivative to dimethyl terephthalate is in the range of 2:4 to 3:3.

* * * * *